US006567004B1

(12) United States Patent
Landa et al.

(10) Patent No.: US 6,567,004 B1
(45) Date of Patent: May 20, 2003

(54) APPARATUS FOR AUTOMATICALLY REPORTING AN EVENT TO A REMOTE LOCATION

(75) Inventors: Joseph S. Landa, Alexandria, VA (US); William E. Blake, Rye, NY (US); Charles K. Collins, Alexandria, VA (US)

(73) Assignee: BriarTek, Inc., Alexandria, VA (US)

( * ) Notice: Subject to any disclaimer, the term of this patent is extended or adjusted under 35 U.S.C. 154(b) by 0 days.

(21) Appl. No.: 09/472,823

(22) Filed: Dec. 28, 1999

(51) Int. Cl.[7] ..... G08B 23/00

(52) U.S. Cl. ..... 340/573.1; 340/573.4; 340/573.6; 340/539; 340/568.1; 340/988

(58) Field of Search ..... 340/573.1, 573.6, 340/539, 573.4, 612, 540, 988, 825.49, 568.1, 571, 686.1, 687, 686.6

(56) References Cited

U.S. PATENT DOCUMENTS

| | | | | | |
|---|---|---|---|---|---|
| 3,644,883 | A | | 2/1972 | Borman et al. | |
| 4,067,411 | A | | 1/1978 | Conley et al. | |
| 4,305,143 | A | * | 12/1981 | Simms | 340/573 |
| 4,491,966 | A | * | 1/1985 | Morcerf | 340/825.54 |
| 4,593,274 | A | | 6/1986 | Rizzo | |
| 4,918,433 | A | * | 4/1990 | Moore | 340/573 |
| 5,029,293 | A | * | 7/1991 | Fontanille | 340/573 |
| 5,045,839 | A | * | 9/1991 | Ellis | 340/539 |
| 5,144,323 | A | | 9/1992 | Yonkers | |
| 5,382,943 | A | | 1/1995 | Tanaka | |
| 5,574,999 | A | | 11/1996 | Gropper | |
| 5,629,689 | A | | 5/1997 | Curwood | |
| 5,630,209 | A | | 5/1997 | Wizgall et al. | |
| 5,712,619 | A | * | 1/1998 | Simkin | 340/539 |
| 5,745,034 | A | | 4/1998 | Andersen et al. | |
| 5,760,681 | A | | 6/1998 | Varis et al. | |
| 5,768,343 | A | | 6/1998 | Dame et al. | |
| 5,781,852 | A | | 7/1998 | Gropper | |
| RE35,920 | E | | 10/1998 | Sorden et al. | |
| 5,844,862 | A | | 12/1998 | Cocatre-Zilgien | |
| 5,861,819 | A | | 1/1999 | Kondo | |
| 5,874,897 | A | * | 2/1999 | Klempau | 340/573.1 |
| 5,874,898 | A | | 2/1999 | Peralta et al. | |
| 5,879,309 | A | | 3/1999 | Johnson et al. | |
| 5,886,635 | A | * | 3/1999 | Landa | 340/573.6 |
| 5,937,823 | A | | 8/1999 | Reeder et al. | |

(List continued on next page.)

FOREIGN PATENT DOCUMENTS

| | | |
|---|---|---|
| JP | 11-053665 | 2/1999 |

*Primary Examiner*—Benjamin C. Lee
(74) *Attorney, Agent, or Firm*—IP Strategies, PC

(57) ABSTRACT

An apparatus for automatically reporting an event includes an actuator having a sensor for sensing the event and providing an actuation signal, a controller having a signal generator for formatting data corresponding to the event to form a report signal, and a transmitter for transmitting the report signal. The actuator may include a water-activated switch to sense the event or a motion detector to sense the event. The actuator may sense a signal corresponding to a change in a monitored physiological parameter of a person coupled to the apparatus. The apparatus may also include a global positioning system receiver. The report signal may be formed according to standard digital selective calling. A process of automatically reporting an event includes sensing the event, providing an actuation signal in response to the sensed event, formatting data corresponding to the event in response to the actuation signal, to form a report signal, and transmitting the report signal. Sensing the event may include sensing contact of a subject of the event with water, sensing an absence of motion of a subject of the event, or sensing a change in a monitored physiological parameter of a subject of the event. Data corresponding to the event may include global positioning system data. Formatting data corresponding to the event may include formatting the data according to standard digital selective calling protocol.

67 Claims, 2 Drawing Sheets

U.S. PATENT DOCUMENTS 5,945,912 A * 8/1999 Guldbrand ..... 340/573.1
5,963,130 A * 10/1999 Schlager ..... 340/540
5,966,692 A 10/1999 Langer et al.
5,982,322 A 11/1999 Bickley et al.
6,057,759 A * 5/2000 Marsh ..... 340/539
6,198,394 B1 * 3/2001 Jacobsen et al. ..... 340/573.1

* cited by examiner

APPARATUS FOR AUTOMATICALLY REPORTING AN EVENT TO A REMOTE LOCATION

FIELD OF THE INVENTION

The present invention relates in general to event notification systems. In particular, the present invention relates to a device that automatically transmits a standard-format report signal when an event occurs in a monitored situation. The standard-format signal can be received and understood by remote standard-format receivers within range of the device, so that personnel present at the remote location, or those monitoring the receiver, can respond to the event.

In a particular preferred embodiment, the present invention relates in general to maritime emergency alarm systems. In particular, the exemplary embodiment of the present invention relates to a device that automatically transmits a pre-formatted message using the Digital Selective Calling (DSC) protocol when a person or object unintentionally enters a body of water. The system of the invention is activated when, for example, the person or object falls from a ship or dock into the water, when a ship lists or sinks, or when a crewmember or passenger otherwise becomes incapacitated and is unable to manually activate an alarm.

BACKGROUND OF THE INVENTION

Systems that monitor a situation or location for occurrence of an event, and which provide an alarm in response to the event, are well-known and are embodied in many different designs. Some of these systems include devices that are particularly designed for alerting potential rescuers in the event of a maritime overboard emergency. These devices, once activated, send a signal indicating that an emergency event has occurred. For example, some devices issue a simple alarm signal, such as a flashing light or audible signal. Activation of these devices may be automatic, such as by contact with water, or manual. The alert issued by different devices varies, and devices that issue such alerts, known as emergency position-indicating radio beacons ("EPIRBs"), are organized into several classes. Some classes of EPIRBs are capable of transmitting data, which may include the name or location of the vessel in trouble. These signals may be of the type that are monitored by a constellation of satellites, in which case the alarms are relayed to local rescue resources. Some of these devices generate special-purpose alarms, such as man overboard alarms, which can warn the crew in the event that a person falls overboard a vessel. A transceiver on the vessel can relay the alarm to other systems, such as EPIRBs or marine radios, for rescue backup.

Another system for alerting authorities in an emergency is DSC. An international committee conceived and standardized Digital Selective Calling in the early 1970's. Its purpose is to expedite the handling of traffic in the maritime service by facilitating more efficient calling and to provide a more automated standard distress and safety system. Recently, many nations have been encouraging the implementation of DSC systems in the VHF band in hopes of relieving some of the congestion on the voice distress and calling channel, channel 16. DSC helps solve this problem because it uses channel 70 VHF (156.525 Mhz) for its routine calling.

In the near future, a network of Public Coast Stations will be equipped to receive VHF/DSC calls and to offer the mariner completely automatic telephone facilities.

The Coast guard petitioned the FCC in 1992 to require that all marine radios made or sold in the US have DSC capability. The Coast Guard also asked the Radio Technical Commission for Maritime Services (RTCM), a non-profit standards organization, to develop a standard that would allow incorporation of DSC in a marine radio without affecting the low-end market price of that radio. The FCC solicited comments on that petition in 1992 and 1993 and prepared a Notice of Proposed Rule Making on that and other radio communications matters in early 1994. The FCC requested comments concerning that rule making from May through November of 1995. On Jun. 27, 1997, the FCC adopted a Report and Order requiring that any radio type accepted on or after Jun. 17, 1999 must include at least minimal DSC capability.

DSC allows mariners to send an automatically-formatted standard distress alert to the Coast Guard or other rescue authority anywhere in the world. Digital Selective Calling also allows a mariner to initiate or receive distress, urgency, safety, and routine radiotelephone calls to or from any similarly-equipped vessel or shore station. DSC allows for addressing of specific other radios when transmitting the alert, and allows others to respond specifically to the caller. This capability is available because DSC may be used to designate a telephone as the terminal equipment in the DSC message, and provide the PSTN address as selection information in the data. Thus, a point-to-point distress call may be completed, even when the receiving entity is not connected to a radio loudspeaker. DSC allows for storage records of failed attempts to reach another radio, at that radio.

Distress alerts can be relayed to other ships within radio range (usually up to about 30 miles) or directly to a shore station, which can forward the alert to U.S. Coast Guard rescue coordination centers (RCC).

It would be advantageous to apply the DSC signaling standard to a man overboard-type device or other safety alarm apparatus. However, no conventional personal safety alarm system interfaces with a DSC-equipped radio to provide a system that will automatically activate during an emergency and transmit the appropriate data using DSC protocols. Further, no radio has been modified to include automatic actuation for transmission of a DSC signal during a crisis event. There is a need for such a device, in order to improve signaling capability during an emergency situation.

Generally stated, there would be an advantage to providing a system that includes a reporting device that automatically transmits a signal having a standard report format in response to the occurrence of an event in a monitored situation. Such a standard-format signal could be received and recognized by any remote receiver, so that a response to the event can be initiated by personnel monitoring the remote receiver. Such a system would be useful in myriad situations in which direct monitoring of the situation for the event is not possible or practical.

SUMMARY OF THE INVENTION

It is therefore an objective of the present invention to provide a system that senses an event and, in response, automatically generates a standard-format report signal.

It is a further objective of the present invention to provide a system that senses an event and, in response, automatically generates a report signal corresponding to the event.

It is another objective of the present invention to provide a system having a device that senses an event in one of several situations being monitored and, in response, generates a report signal formatted to correspond to the sensed event.

It is an additional objective of the present invention to provide a system having a device that senses an event and, in response, generates a report signal formatted to DSC protocols.

It is also an objective of the present invention to provide a system having a device that senses an event in one of several situations being monitored and, in response, generates a report signal formatted to DSC protocols and having data content corresponding to the sensed event.

According to one aspect of the present invention, an apparatus for automatically reporting an event includes an actuator, including a sensor for sensing the event and providing an actuation signal in response to the sensed event; a controller, including a signal generator for formatting data corresponding to the event in response to the actuation signal, to form a report signal; and a transmitter for transmitting the report signal. The actuator may include a water-activated switch to sense the event, wherein the event is contact of the apparatus with water, or a motion detector to sense the event, wherein the event is an absence of motion of the apparatus. Alternatively, the actuator may sense a signal corresponding to a change in a monitored physiological parameter of a person coupled to the apparatus. The apparatus may also include a global positioning system receiver. Preferably, the signal generator forms the report signal according to standard digital selective calling protocol, and the transmitter is a digital selective calling transmitter. The transmitter may be disposed in a buoyant cradle. The apparatus may also include a remote receiver for receiving the report signal and formatting the received report signal according to the digital selective calling protocol.

According to another aspect of the present invention, an apparatus for automatically reporting an event includes an actuator, including a sensor for sensing the event and providing an actuation signal in response to the sensed event; a signal generator for generating a report signal in response to the actuation signal; and a transmitter for transmitting the report signal. The actuator may include a water-activated switch to sense the event, wherein the event is contact of the apparatus with water, or a motion detector to sense the event, wherein the event is an absence of motion of the apparatus. Alternatively, the actuator may sense a signal corresponding to a change in a monitored physiological parameter of a person coupled to the apparatus. The apparatus may include a global positioning system receiver. Preferably, the signal generator generates the report signal according to standard digital selective calling protocol, and the transmitter is a digital selective calling transmitter. The transmitter may be disposed in a buoyant cradle. The apparatus may also include a remote receiver for receiving the report signal and formatting the received report signal according to the digital selective calling protocol.

According to a further aspect of the present invention, a reporting unit for automatically providing a report of an event to a remote location includes an actuator, including a sensor for sensing the event and providing an actuation signal in response to the sensed event; a controller, including a signal generator for formatting a digital selective calling protocol signal corresponding to the event, in response to the actuation signal; and a transmitter for transmitting the digital selective calling protocol signal to the remote location. The actuator may include a water-activated switch to sense the event, wherein the event is contact of the apparatus with water, or a motion detector to sense the event, wherein the event is an absence of motion of the apparatus. Alternatively, the actuator may sense a signal corresponding to a change in a monitored physiological parameter of a person coupled to the apparatus. The apparatus may also include a global positioning system receiver. The transmitter may be disposed in a buoyant cradle. The apparatus may also include a remote receiver for receiving the report signal and formatting the received report signal according to the digital selective calling protocol.

According to an additional aspect of the present invention, a process of automatically reporting an event includes sensing the event, providing an actuation signal in response to the sensed event, formatting data corresponding to the event in response to the actuation signal, to form a report signal, and transmitting the report signal. Sensing the event may include sensing contact of a subject of the event with water, sensing an absence of motion of a subject of the event, or sensing a change in a monitored physiological parameter of a subject of the event. The subject of the event may be a person or an object such as a cargo container. Data corresponding to the event may include global positioning system data. Formatting data corresponding to the event may include formatting the data according to standard digital selective calling protocol. The process may also include remotely receiving the report signal, and formatting the received report signal according to digital selective calling protocol.

According to another aspect of the present invention, a process of automatically reporting an event includes sensing the event, providing an actuation signal in response to the sensed event, generating a report signal in response to the actuation signal, and transmitting the report signal. Sensing the event may include sensing contact of a subject of the event with water, sensing an absence of motion of a subject of the event, or sensing a change in a monitored physiological parameter of a subject of the event. The subject of the event may be a person or an object such as a cargo container. The report signal may include global positioning system data. Generating the report signal may include formatting the report signal according to standard digital selective calling protocol. The process may also include remotely receiving the report signal, and formatting the received report signal according to digital selective calling protocol.

According to a further aspect of the present invention, a process of automatically providing a report of an event to a remote location includes sensing the event and providing an actuation signal in response to the sensed event, formatting a digital selective calling protocol signal corresponding to the event, in response to the actuation signal, and transmitting the digital selective calling protocol signal to the remote location. Sensing the event may include sensing contact of a subject of the event with water, sensing an absence of motion of a subject of the event, or sensing a change in a monitored physiological parameter of a subject of the event. The subject of the event may be a person or an object such as a cargo container. The process may also include remotely receiving the report signal, and formatting the received report signal according to digital selective calling protocol.

BRIEF DESCRIPTION OF THE DRAWING FIGURES

These and other objectives and advantages of the present invention will be apparent from the following detailed description, with reference to the drawings, in which FIG. 1 shows the major components of the individual signaling unit of the present invention;

DETAILED DESCRIPTION OF THE PRESENT INVENTION

The system of the present invention provides switching and control capability for automatically actuating a transceiver, preferably a DSC transceiver, on occurrence of a predetermined event, usually an emergency event. The system includes an individual signaling unit including an actuator, controller, and transceiver, and is preferably a portable unit to be worn or held by a person, or attached to an object. Examples of actuating events include a person falling overboard a ship, a ship listing or sinking, a person being rendered unconscious, and a person exhibiting a particular medical or physiological condition.

When an actuating event occurs, the individual signaling unit generates and transmits an appropriate report signal for reception by a remote transceiver located within the operating range of the individual signaling unit transceiver. The remote transceiver responds appropriately. Preferably, the appropriate response includes an acknowledgment to the individual unit, and determination of the data content, if any, of the report signal. Personnel monitoring the remote transceiver can then respond to the report signal in a manner appropriate for the presence or data content of the report signal.

According to a preferred embodiment of the invention, when an actuating event occurs, the individual signaling unit generates and transmits an appropriate DSC report signal for reception by a remote DSC transceiver located within operating range. The remote DSC transceiver responds appropriately. Preferably, the appropriate response includes an acknowledgment to the individual signaling unit, and determination of the data content of the DSC report signal. Because the DSC report signal is a standard format, the data content of the report signal is readily identifiable, even by a remote transceiver that was not expecting or looking for the report signal.

Figure 2:
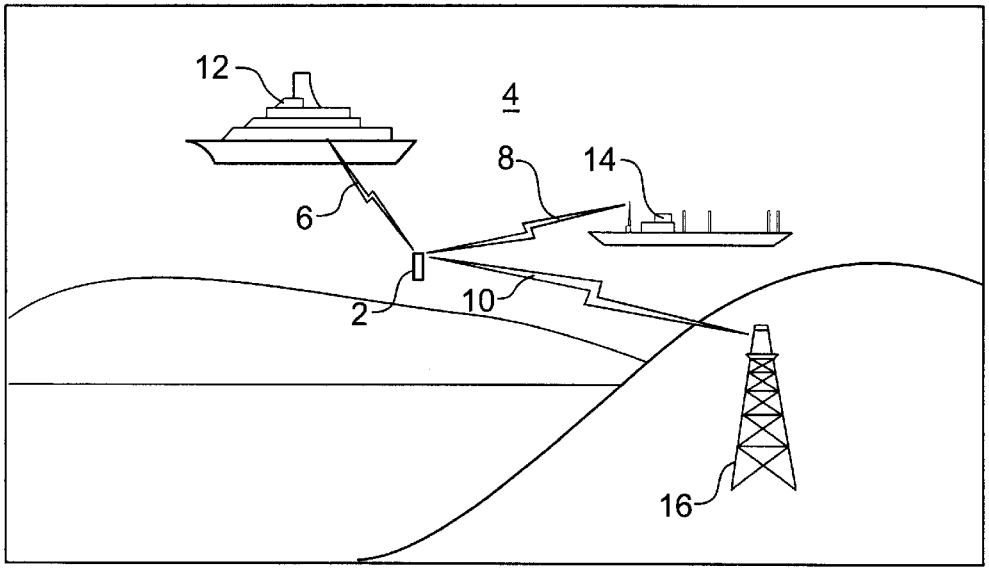
FIG. 2 illustrates an exemplary situation for advantageous use of the present invention to report an event.

FIG. 2 shows an exemplary situation of an advantageous use of the system of the present invention. A person 2 has fallen overboard a ship 12, and is now in the water 4. Sensing the water 4, the individual signaling unit carried by the person 2 automatically generates and transmits a report signal 6, 8, 10, which is received at the ship 12 from which the person 2 fell overboard, another passing ship 14, and a land monitoring station 16, respectively. Personnel located at these positions are now aware of the overboard event.

Figure 1:
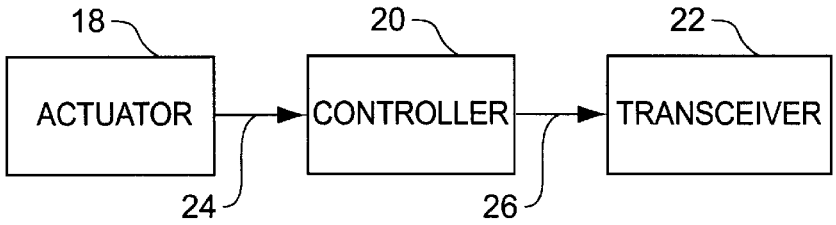
Figure 4:
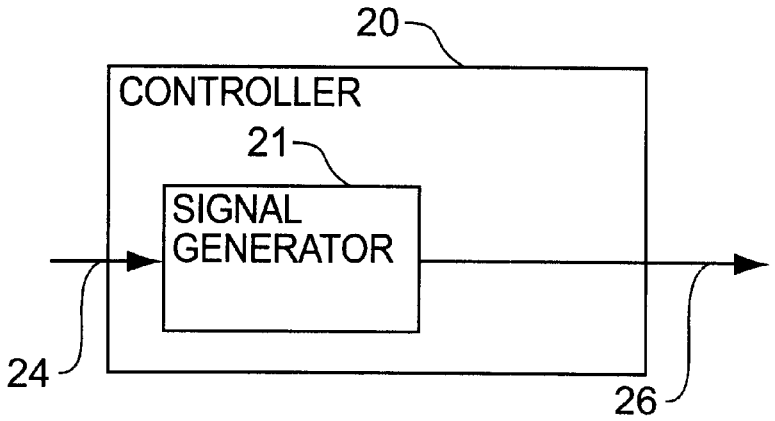
FIG. 4 is a block diagram of an exemplary controller of the individual signaling unit of the present invention.

With reference to FIG. 1, the individual signaling unit includes an actuator 18, a controller 20, and a transceiver 22. The actuator 18 senses the actuating event and responds by sending an actuation signal 24 to the controller 20. The controller 20 interprets the actuation signal 24 to generate and format a report signal 26 for the transceiver 22. As shown in FIG. 4, the controller 20 can include a signal generator 21 for generating and formatting the report signal. The transceiver 22 receives the formatted report signal 26, and transmits it for reception by a remote transceiver.

In a preferred embodiment, the controller 20 formats the report signal 26 according to standard DSC protocol, for intended reception by a remote transceiver that can interpret the DSC-formatted report signal 26.

The remote transceiver receives the report signal and, based on the detected format, processes the report signal to determine the data content. For example, if the format is the DSC communications protocol, several data fields will be identified and the contents interpreted. Because a standard signal protocol preferably is used, the response to the data read in the signal is also standard, unless flagged as an undesignated situation, in which case a person is alerted to the situation for a manual response.

The actuator, which is preferably always active, is a circuit that is designed to sense a particular physical change in environment, and to generate a signal or toggle a signal level when that change is detected.

Figure 3:
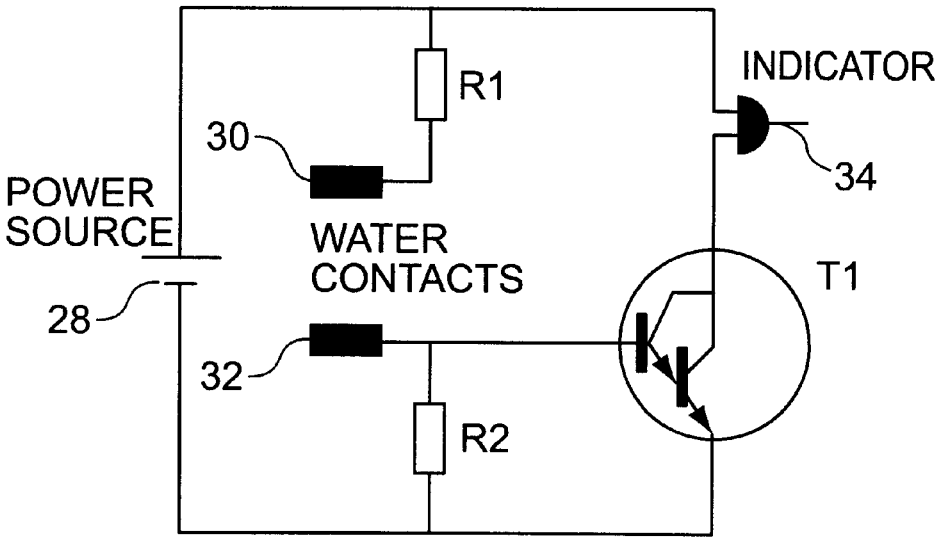
FIG. 3 is a schematic diagram of an exemplary actuator of the present invention.

For example, referring to FIG. 3, the actuator may be a water-activated switch. In such a case, the individual signaling unit may be worn on a person. For example, the unit may be attached to the person's clothing. Alternatively, the unit may be attached to an object, such as a crate or other cargo container that is being delivered by ship. If the person or object is thrown overboard, the unit is immersed in the water. Once immersed, the actuator is switched on, and sends a signal to the controller. According to the exemplary circuit, a power source 28 is connected to an amplifier arrangement T1 and a voltage divider formed by two resistors R1 and R2. An open circuit is present in the voltage divider due to separated water contacts 30, 32. When the individual signaling unit is immersed or splashed with water, indicating that the person or object to which the unit is attached has fallen into the water, an electrical connection is made between the contacts 30, 32 by water touching across the contacts 30, 32. This completes the amplifier circuit, asserting the previously-unasserted signal level at the circuit indicator 34. This level change is the actuation signal that is provided to the controller.

The actuator may sense and report any physical change in environment. For example, instead of a water-activated switch, the actuator may include a motion detector. The detector may be attached to a person working in an isolated area or under hazardous conditions, such as in the presence of noxious fumes. The degree of motion of this person may be monitored at a remote location for the safety of the person wearing the unit. If motion of the unit stops for a period of time exceeding a predetermined threshold, it may be assumed by those at the monitoring station that the person has been rendered unconscious, and appropriate rescue measures may be undertaken.

Alternatively, the actuator having the motion detector-activated switch may be attached to a container that must not be jostled, such as a container of hazardous material. In such a case, the actuator may have a level detector rather than or in addition to the motion detector, so that it may be remotely determined if the container is in danger of being overturned.

There are many medical-type sensors that also could be the activating mechanism in the actuator. For example, a heart rate monitor output may be sensed by the actuator and perceived as safe if it falls within a predetermined range of values. If the patient's heart rate causes the monitor output to fall out of the range, an actuation signal is sent to the controller. Another example is an actuator including a blood oxygen saturation monitor, the output of which is an indication of the physical condition of the person wearing the individual signaling unit. Such an actuator may be readily designed around the activating mechanism by one of ordinary skill in the art, using comparator circuits and the like.

The actuation signal provided by the actuator is preferably a binary logic level signal, with a change in level indicating a change in status of the parameter being monitored. For example, if the actuator is a water-activated switch, a normal indication may be manifested by an actuation signal having a logic level "0", whereas contact with water by the individual unit is indicated by a logic level "1". Conversely, normal may be indicated by "1", and contact with water may be indicated by "0".

Depending on the situation that is being monitored, the actuation signal may be more complex. For example, in the case of a motion detector sensor used as a sensing device in the actuator, the actuation signal may be a signal level that is held for a certain period of time, as counted by the controller. Alternatively, the actuator may include the counter, and only issue the actuation signal after sensing no motion for a predetermined amount of time.

The controller receives the actuation signal and generates and formats an appropriate report signal, based on the actuation signal. Any circuit that is capable of generating the formatted report signal in response to the actuation signal is contemplated for use with the present invention. In the simplest case, the controller receives an actuation signal that is merely a logic level. The controller in this case is only expecting one type of event indication, and only prepares one type of report signal in response. Under more complicated conditions, the controller may generate a multiple number of responses, each having a different format, for serial or parallel transmission by the transceiver. Generation of the multiple signals may be routine, or may be selected as a consequence of another external indication received by the controller, such as a global positioning system (GPS) input from the ship's GPS system or elsewhere, or a manual actuation input. In this case, the external input to the controller would in part dictate the format of the report signal.

In some cases, however, the actuation signal may be more complicated than a mere change in level. For example, an individual signaling unit on board a water-borne vessel may distinguish between two situations that would require a report signal, such as listing and sinking. Thus, two actuators may be present on board the vessel, each providing an actuation signal to the controller. The listing actuator may be a level detector that signals the controller when the vessel tilts beyond a listing threshold. The sinking actuator may be a water-activated switch that signals the controller when in contact with water. Thus, the controller must have the ability to judge whether the indication is one of listing or sinking, and format the control signal to the transceiver correspondingly. In this way, the transceiver can format the report signal to report the proper condition. Providing information related to two potential monitored events may involve providing a two-bit actuation signal to the controller, or may require a content-based actuation signal to be produced. Such a content-based signal could provide further information about the event. For example, in the case where the activating device of the actuator is a heart rate indicator, the actuation signal could represent the actual measured heart rate. In the case where a blood oxygen saturation monitor is utilized as the activating device, the actuation signal could represent the measured blood oxygen level.

The controller is programmed to provide the proper report signal in response to the particular received actuation signal. The controller may be a hardwired, discrete circuit that provides a hardware translation of the actuation signal. Alternatively, the controller can be an off-the-shelf microprocessor or programmable logic array that is programmed to provide the report signal in response to the actuation signal. Various support hardware may also be provided, such as counters to provide delays in the case of a timed input condition, or memory devices such as lookup tables. Data interfaces, including buffer circuits, for example, are also included in the controller. These data interfaces provide a sufficient number of I/O pins or ports to interface the controller with the actuator, the transceiver, and any external input mechanisms.

The controller preferably also provides all power management functions for the individual signaling unit, as well as any clock signals necessary for synchronous operation. If the controller includes an off-the-shelf microprocessor, the clock may be provided by an internal oscillator. Program logic and memory may reside on separate chips, or may be included in a single-chip processor.

The transceiver receives the formatted report signal from the controller, and transmits the report signal. According to the example described earlier, the transceiver would receive a report signal indicating that the person wearing the individual signaling device has fallen overboard, and transmit the report signal for reception by a remote transceiver as a man overboard report. Listing and sinking reports according to previous examples would be transmitted in the same way.

Thus, the transceiver is equipped with hardware, and any appropriate software or firmware, necessary to transmit the report signal. The transceiver is tuned to transmit at the appropriate carrier frequency, and at a signal strength dictated by the situation in which the present invention is used. The transceiver may be connected to the rest of the individual signaling unit by a length of cable so that the transceiver may float to the surface of the water in case the person or object to which it is attached sinks below the surface of the water. To ensure floatation of the transceiver, the transceiver may be disposed in or enclosed in a buoyant cradle. The cradle may include a flashing light, an audible alarm, or any other indicia that may be seen by rescue personnel or other passersby, to assist in locating the person or object.

The transceiver preferably also includes a receiver for receiving an acknowledgment or instructions from the remote transceiver. The acknowledgment or instructions may be provided to the controller for processing. In response to the acknowledgment signal, the controller may cause the transceiver to stop transmission of the report signal, or may provide an additional message to be transmitted by the transceiver. The controller may also store the acknowledgment or instructions in memory located in the controller or elsewhere in the individual signaling unit, for display or later retrieval. The received signal may be time-stamped. If the controller is provided with a GPS input, positioning information may also be tagged to the report signal, for provision to the remote transceiver, or to the information received from the remote transceiver, for storage with that information.

GPS information is particularly advantageous in the case of a person falling overboard a ship. In such a case, the location information provided by the GPS data helps expedite rescue of that person. In the case of cargo falling overboard, the GPS data also provides localized warning to other ships in the vicinity, so that they may avoid collision with the overboard cargo.

In the case that the report signal is formatted for DSC transmission, a DSC transceiver is used. The transceiver in this case is a narrowband FM transmitter/receiver tuned to marine channel 70 using frequency shift keyed subcarrier modulation.

In an exemplary embodiment, the transceiver may be of the type that is not a DSC transceiver, that is, the controller does not format the report signal according to DSC protocol. In such a case, the receiver at a remote transceiver can receive the report signal. If this receiver is provided with an interface with a DSC transmitter, the report signal can be converted to DSC format at the remote receiver. The DSC converted report signal can then be transmitted to other remote DSC transceivers. In this way, the first receiver acts as a smart relay to provide a DSC report signal.

In summary, according to the present invention, the occurrence of a predetermined situation automatically causes a report of that occurrence to be generated and transmitted to a remote transceiver. At the remote location, some indication is given to personnel who can respond to the situation. Preferably, the remote transceiver also automatically generates an acknowledgment signal, which is received by the transceiver on the individual signaling unit. Receipt of the acknowledgment signal may be stored at the individual signal unit for later analysis, for example, of the response time of response personnel, or of the technical performance of the system.

The remote transceiver(s) receiving the report signal will recognize the format of the signal and process it accordingly. Thus, as previously illustrated with reference to FIG. 2, a report signal transmitted by the individual signaling unit worn by a person who fell overboard a ship will be received by shore-based monitoring stations, passing ships, and the ship on which the person had been a passenger or crew member, provided that they are all within range of the transceiver output.

If the transceiver is a DSC transceiver, another factor that determines in part which remote receivers will respond to the report signal is the format specifier of the DSC report signal. That is, characters in the DSC signal may direct the signal to particular receivers, such as a receiver on a particular individual vessel or at a particular individual station, receivers of a group of ships in a particular geographic area, or receivers of a group of ships having a common interest. Other DSC receivers will receive the report signal, but will ignore it after the format specifier is read. Of course, "distress" and "all ships" report messages may be specified to reach out to all receivers within range, both on ship stations and at coast stations. For report signals directed to receivers in a particular geographic location, the ship's GPS system may be used to provide GPS data for insertion into the geographic location field of the DSC signal. Alternatively, a GPS receiver may be embedded in the individual signaling unit to provide this information.

The call sequence of a distress DSC report signal may include message elements that identify the nature of the distress, such as man overboard, flooding, grounding, sinking, and listing. This information helps rescue personnel to respond appropriately to the event initiating the report signal.

While the present invention has been described by way of example and in terms of preferred and alternative embodiments, it is to be understood that the present invention is not limited to the disclosed embodiments. To the contrary, the present invention is intended to include various modifications and similar arrangements. Therefore, the appended claims should be accorded the broadest interpretation so as to encompass all such modifications and similar structures.

What is claimed is:

1. An apparatus for automatically reporting an emergency event, comprising:

an actuator, including a sensor for sensing the event and providing an actuation signal in response to the sensed event;

a controller, including a signal generator for formatting data corresponding to the event in response to the actuation signal, to form a report signal; and a transmitter for transmitting the report signal;

wherein the controller is disposed in a first housing attached to a subject of the emergency event;

the transmitter is disposed in a second housing;

the transmitter is connected to the controller by a cable; and the second housing is a bouyant cradle.

2. The apparatus of claim 1, wherein the actuator includes a water-activated switch to sense the event, wherein the event is contact of the apparatus with water.

3. The apparatus of claim 1, wherein the actuator includes a motion detector to sense the event, wherein the event is an absence of motion of the apparatus.

4. The apparatus of claim 1, wherein the actuator senses a signal corresponding to a change in a monitored physiological parameter of a person coupled to the apparatus.

5. The apparatus of claim 1, further including a global positioning system receiver.

6. The apparatus of claim 1, wherein the signal generator forms the report signal according to standard digital selective calling protocol, and the transmitter is a digital selective calling transmitter.

7. The apparatus of claim 6, wherein the signal generator forms the report signal automatically, according to standard digital selective calling protocol.

8. The apparatus of claim 1, further comprising a remote receiver for receiving the report signal and for formatting the received report signal according to digital selective calling protocol.

9. The apparatus of claim 1, wherein the report signal includes data content related to the event.

10. The apparatus of claim 9, wherein the data content is arranged in a data field.

11. The apparatus of claim 9, wherein the data content is arranged in a plurality of data fields.

12. The apparatus of claim 1, wherein the controller provides the formatted report signal directly to the transmitter.

13. The apparatus of claim 1, wherein the actuator is a plurality of actuators, including a respective plurality of sensors, wherein each said sensor senses a separate event.

14. The apparatus of claim 13, wherein the report signal includes data content related to the event, and the data content includes an identification of the sensed event.

15. The apparatus of claim 1, wherein the actuation signal is a binary signal.

16. The apparatus of claim 15, wherein the binary signal indicates only the presence or absence of the event.

17. The apparatus of claim 16, wherein the signal generator provides a format for the report signal based solely on the binary signal.

18. An apparatus for automatically reporting an emergency event, comprising:

an actuator, including a sensor for sensing the event and providing an actuation signal in response to the sensed event;

a signal generator for generating a formatted data report signal in response to the actuation signal; and a transmitter for transmitting the report signal;

wherein the actuator is disposed in a first housing attached to a subject of the emergency event;

the transmitter is disposed in a second housing;

the transmitter is connected to the actuator by a cable; and the second housing is a buoyant cradle.

19. The apparatus of claim 18, wherein the actuator includes a water-activated switch to sense the event, wherein the event is contact of the apparatus with water.

20. The apparatus of claim 18 wherein the actuator includes a motion detector to sense the event, wherein the event is an absence of motion of the apparatus.

21. The apparatus of claim 18, wherein the actuator senses a signal corresponding to a change in a monitored physiological parameter of a person coupled to the apparatus.

22. The apparatus of claim 18, further including a global positioning system receiver.

23. The apparatus of claim 18, wherein the signal generator generates the report signal according to standard digital selective calling protocol, and the transmitter is a digital Detective calling transmitter.

24. The apparatus of claim 18, further comprising a remote receiver for receiving the report signal and for formatting the received report signal according to digital selective calling protocol.

25. A reporting unit for automatically providing a report of an emergency event to a remote location, comprising:

an actuator, including a sensor for sensing the event and providing an actuation signal in response to the sensed event;

a controller, including a signal generator for formatting a digital selective calling protocol signal corresponding to the event, in response to the actuation signal; and a transmitter for transmitting the digital selective calling protocol signal to the remote location;

wherein the actuator is disposed in a first housing attached to a subject of the emergency event;

the transmitter is disposed in a second housing;

the transmitter is connected to the actuator by a cable; and the second housing is a buoyant cradle.

26. The apparatus of claim 25, wherein the actuator includes a water-activated switch to sense the event, wherein the event is contact of the apparatus with water.

27. The apparatus of claim 25, wherein the actuator includes a motion detector to sense the event, wherein the event is an absence of motion of the apparatus.

28. The apparatus of claim 25, wherein the actuator senses a signal corresponding to a change in a monitored physiological parameter of a person coupled to the apparatus.

29. The apparatus of claim 25, further including a global positioning system receiver.

30. The apparatus of claim 25, further comprising a remote receiver for receiving the report signal and for formatting the received report signal according to digital selective calling protocol.

31. A process of automatically reporting an emergency event, comprising:

sensing the event at a location of a subject of the event;

providing an actuation signal in response to the sensed event from a first housing disposed at the location of the subject of the event;

formatting data corresponding to the event in response to the actuation signal, to form a report signal; and transmitting the report signal from a second housing that is disposed in a buoyant cradle and connected to the first housing by a cable.

32. The process of claim 31, wherein sensing the event includes sensing contact of the subject of the event with water.

33. The process of claim 32, wherein the subject of the event is a person.

34. The process of claim 32, wherein the subject of the event is a cargo container.

35. The process of claim 31, wherein sensing the event includes sensing an absence of motion of the subject of the event.

36. The process of claim 31, wherein sensing the event includes sensing a change in a monitored physiological parameter of the subject of the event.

37. The process of claim 31, wherein data corresponding to the event includes global positioning system data.

38. The process of claim 31, wherein formatting data corresponding to the event includes formatting the data according to standard digital selective calling protocol.

39. The process of claim 38, wherein formatting data corresponding to the event includes formatting the data automatically.

40. The process of claim 31, further comprising:

remotely receiving the report signal; and formatting the received report signal according to digital selective calling protocol.

41. The process of claim 31, wherein formatting data corresponding to the event to form the report signal includes including data content related to the event in the report signal.

42. The process of claim 41, further including arranging the data content in a data field.

43. The process of claim 41, further including arranging the data content in a plurality of data fields.

44. The process of claim 31, further including providing the formatted report signal directly to the transmitter.

45. The process of claim 31, wherein providing an actuation signal in response to the sensed event includes providing a plurality of actuation signals in response to a respective plurality of sensed events.

46. The process of claim 45, wherein formatting data the corresponding to the event to form the report signal includes including data content related to the event in the report signal, wherein the data content includes an identification of the sensed event.

47. The process of claim 31, wherein the actuation signal is a binary signal.

48. The process of claim 47, wherein the binary signal indicates only the presence or absence of the event.

49. The process of claim 48, wherein the data is formatted based solely on the binary signal.

50. The process of claim 31, further comprising modulating the report signal with a carrier signal, prior to transmitting the report signal.

51. A process of automatically reporting an emergency event, comprising:

sensing the event at a location of a subject of the event;

providing an actuation signal in response to the sensed event from a first housing disposed at the location of the subject of the event;

generating a formatted data report signal in response to the actuation signal; and transmitting the report signal from a second housing that is disposed in a buoyant cradle and connected to the first housing by a cable.

52. The process of claim 51, wherein sensing the event includes sensing contact of the subject of the event with water.

53. The process of claim 52, wherein the subject of the event is a person.

54. The process of claim 52, wherein the subject of the event is a cargo container.

55. The process of claim 52, wherein transmitting the report signal includes initiating the transmission from within the buoyant cradle, which is remote from and in communication with the source of the generation of the report signal.

56. The process of claim 51, wherein sensing the event includes sensing an absence of motion of the subject of the event.

57. The process of claim 51, wherein sensing the event includes sensing a change in a monitored physiological parameter of the subject of the event.

58. The process of claim 51, wherein the report signal includes global positioning system data.

59. The process of claim 51, wherein generating the report signal includes formatting the report signal according to standard digital selective calling protocol.

60. The process of claim 51, further comprising:

remotely receiving the report signal; and formatting the received report signal according to digital selective calling protocol.

61. A process of automatically providing a report of an emergency event to a remote location, comprising:

sensing the event at a location of a subject of the event and providing an actuation signal in response to the sensed event from a first housing disposed at the location of the subject of the event;

formatting a digital selective calling protocol signal corresponding to the event, in response to the actuation signal; and transmitting the digital selective calling protocol signal to the remote location from a second housing that is disposed in a buoyant cradle and connected to the first housing by a cable.

62. The process of claim 61, wherein sensing the event includes sensing contact of the subject of the event with water.

63. The process of claim 62, wherein the subject of the event is a person.

64. The process of claim 62, wherein the subject of the event is a cargo container.

65. The process of claim 61, wherein sensing the event includes sensing an absence of motion of the subject of the event.

66. The process of claim 61, wherein sensing the event includes sensing a change in a monitored physiological parameter of the subject of the event.

67. The process of claim 61, further comprising:

remotely receiving the report signal; and formatting the received report signal according to digital selective calling protocol.

* * * * *